US010937412B2

(12) United States Patent
Chae et al.

(10) Patent No.: US 10,937,412 B2
(45) Date of Patent: Mar. 2, 2021

(54) TERMINAL

(71) Applicant: LG ELECTRONICS INC., Seoul (KR)

(72) Inventors: Jonghoon Chae, Seoul (KR); Sungmin Han, Seoul (KR); Yongchul Park, Seoul (KR); Siyoung Yang, Seoul (KR); Juyeong Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 96 days.

(21) Appl. No.: 16/268,333

(22) Filed: Feb. 5, 2019

(65) Prior Publication Data

US 2020/0118543 A1 Apr. 16, 2020

(30) Foreign Application Priority Data

Oct. 16, 2018 (KR) ..... 10-2018-0123044

(51) Int. Cl.

| | |
|---|---|
| ***G10L 13/00*** | (2006.01) |
| ***G10L 13/10*** | (2013.01) |
| ***G10L 13/047*** | (2013.01) |
| ***G10L 13/08*** | (2013.01) |

(52) U.S. Cl.

CPC ..... *G10L 13/10* (2013.01); *G10L 13/047* (2013.01); *G10L 13/08* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,847,931 | B2 | 1/2005 | Addison et al. | |
| 7,792,673 | B2 | 9/2010 | Oh et al. | |
| 9,761,219 | B2 * | 9/2017 | Xu | G10L 13/04 |
| 10,410,621 | B2 * | 9/2019 | Li | G10L 15/142 |
| 2012/0089402 | A1 * | 4/2012 | Latorre | G10L 13/10 704/260 |

FOREIGN PATENT DOCUMENTS

| | | |
|---|---|---|
| KR | 1020160049804 | 5/2016 |
| KR | 1020170107683 | 9/2017 |

OTHER PUBLICATIONS

PCT International Application No. PCT/KR2019/001789, Notification of Transmittal of the International Search Report and the Written Opinion of the International Searching Authority, or Declaration dated Jul. 11, 2019, 10 pages.

* cited by examiner

*Primary Examiner* — Vu B Hang
(74) *Attorney, Agent, or Firm* — Lee, Hong, Degerman, Kang & Waimey PC

(57) ABSTRACT

According to an embodiment of the present invention, there is provided a terminal including a memory which stores a prosody correction model; a processor which corrects a first prosody prediction result of a text sentence to a second prosody prediction result based on the prosody correction model and generates a synthetic speech corresponding to the text sentence having a prosody according to the second prosody prediction result; and an audio output unit which outputs the generated synthetic speech.

10 Claims, 7 Drawing Sheets

FIG. 6

PROSODY PREDICTION BASED ON TEXT ANALYSIS RESULT

TEXT ANALYSIS RESULT PROSODY PREDICATION

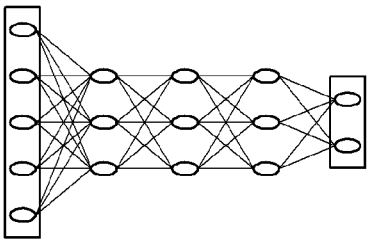

ADVANTAGE :
- LEARNABLE/PREDICTABLE USING TEXT ANALYSIS DATA

DISADVANTAGE :
- ERROR RESIGNATION OF TEXT ANALYZER
- UNIFORM PROSODY PROVISION

PROSODY PREDICTION BASED ON TEXT ANALYSIS RESULT

VOICE ACTOR UTTERANCE RESULT PROSODY PREDICATION

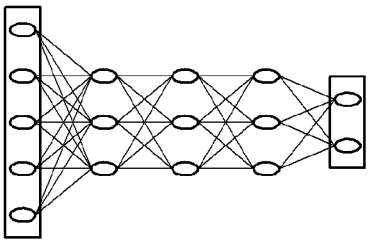

ADVANTAGE :
- LEARNABLE/PREDICTABLE CLOSE TO REAL DATA

DISADVANTAGE :
- NOT SUITABLE FOR REAL-TIME SPEECH SYNTHESIS

PROSODY PREDICATION BASED TEXT ANALYSIS RESULT REAL-TIME CORRECTION

TEXT ANALYSIS RESULT VOICE ACTOR UTTERANCE RESULT PROSODY PREDICATION

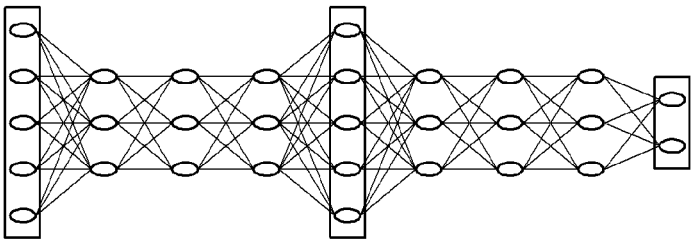

ADVANTAGE :
- LEARNABLE/PREDICTABLE USING TEXT ANALYSIS DATA
- CORRECTABLE TEXT ANALYSIS ERROR BASED ON DIFFERENCE LEARNING
- ACHIEVABLE PREDICATION ACCURACY GOAL BASED ON VOICE ACTOR UTTERANCE

FIG. 7

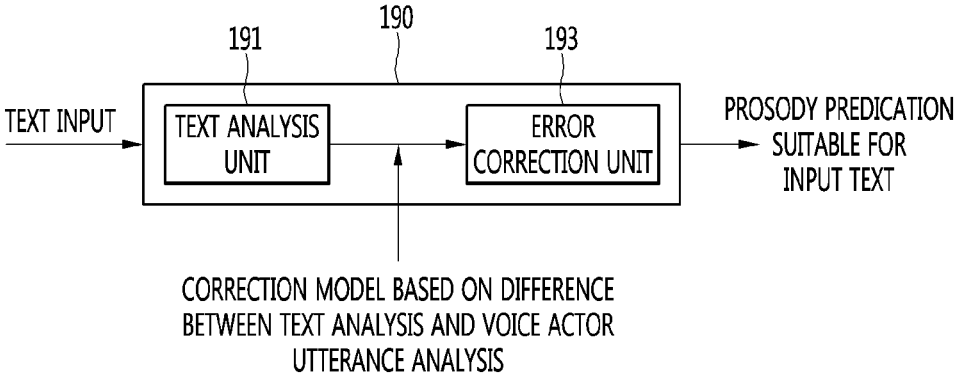

FIG. 8

| Break Index | Description |
|---|---|
| 0 | For cases of clear phonetic marks of "clitic" groups; e.g. application of vowel coalescence rules. Also for cases of 'incomplete nouns', monosyllabic nouns which are, though separated by spaces, not used by themselves but need a modifier |
| 1 | For phrase-internal "word" boundaries which are not marked by such cliticization phenomena and can be pronounced by itself. |
| 2 | For cases of a minimal phrasal disjuncture, with no strong subjective sense of pause -- that is, a sense of phrase edge of the type that is typically associated with the tonal pattern at the right edge of the Accentual Phrase. |
| 3 | For cases of a strong phrasal disjuncture, with a strong subjective sense of pause (whether it be an objective visible pause or only the "virtual pause" cued by final lengthening) -- that is, a sense of phrase break of the type that is typically associated with the tonal pattern at the right edge of an Intonation Phrase. |

FIG. 9

| | |
|---|---|
| $p_1$ | the phoneme identity before the previous phoneme |
| $p_2$ | the previous phoneme identity |
| $p_3$ | the current phoneme identity |
| $p_4$ | the next phoneme identity |
| $p_5$ | the phoneme after the next phoneme identity |
| $p_6$ | position of the current phoneme identity in the current syllable (forward) |
| $p_7$ | position of the current phoneme identity in the current syllable (backward) |
| $a_1$ | whether the previous syllable stressed or not (0: not stressed, 1: stressed) |
| $a_2$ | whether the previous syllable accented or not (0: not accented, 1: accented) |
| $a_3$ | the number of phonemes in the previous syllable |
| $b_1$ | whether the current syllable stressed or not (0: not stressed, 1: stressed) |
| $b_2$ | whether the current syllable accented or not (0: not accented, 1: accented) |
| $b_3$ | the number of phonemes in the current syllable |
| $b_4$ | position of the current syllable in the current word (forward) |
| $b_5$ | position of the current syllable in the current word (backward) |
| $b_6$ | position of the current syllable in the current phrase (forward) |
| $b_7$ | position of the current syllable in the current phrase (backward) |
| $b_8$ | the number of stressed syllables before the current syllable in the current phrase |
| $b_9$ | the number of stressed syllables after the current syllable in the current phrase |
| $b_{10}$ | the number of accented syllables before the current syllable in the current phrase |
| $b_{11}$ | the number of accented syllables after the current syllable in the current phrase |
| $b_{12}$ | the distance per syllable from the previous stressed syllable to the current syllable |
| $b_{13}$ | the distance per syllable from the current syllable to the next stressed syllable |
| $b_{14}$ | the distance per syllable from the previous accented syllable to the current syllable |
| $b_{15}$ | the distance per syllable from the current syllable to the next accented syllable |
| $b_{16}$ | name of the vowel of the current syllable |
| $c_1$ | whether the next syllable stressed or not (0: not stressed, 1: stressed) |
| $c_2$ | whether the next syllable accented or not (0: not accented, 1: accented) |
| $c_3$ | the number of phonemes in the next syllable |
| $d_1$ | gpos (guess part-of-speech) of the previous word |
| $d_2$ | the number of syllables in the previous word |
| $e_1$ | gpos (guess part-of-speech) of the current word |
| $e_2$ | the number of syllables in the current word |
| $e_3$ | position of the current word in the current phrase (forward) |
| $e_4$ | position of the current word in the current phrase (backward) |
| $e_5$ | the number of content words before the current word in the current phrase |
| $e_6$ | the number of content words after the current word in the current phrase |
| $e_7$ | the distance per word from the previous content word to the current word |
| $e_8$ | the distance per word from the current word to the next content word |
| $f_1$ | gpos (guess part-of-speech) of the next word |
| $f_2$ | the number of syllables in the next word |
| $g_1$ | the number of syllables in the previous phrase |
| $g_2$ | the number of words in the previous phrase |
| $h_1$ | the number of syllables in the current phrase |
| $h_2$ | the number of words in the current phrase |
| $h_3$ | position of the current phrase in this utterance (forward) |
| $h_4$ | position of the current phrase in this utterance (backward) |
| $h_5$ | TOBI endtone of the current phrase |
| $i_1$ | the number of syllables in the next phrase |
| $i_2$ | the number of words in the next phrase |
| $j_1$ | the number of syllables in this utterance |
| $j_2$ | the number of words in this utterance |
| $j_3$ | the number of phrases in this utterance |

TERMINAL

CROSS-REFERENCE TO RELATED APPLICATIONS

Pursuant to 35, U.S.C. § 119(a), this application claims the benefit of earlier filing date and right of priority to Korean Patent Application No. 10-2018-0123044, filed on Oct. 16, 2018, the contents of which are hereby incorporated by reference herein in its entirety.

FIELD

The present invention relates to a terminal, and more particularly, to a terminal for effectively performing a prosody prediction of a synthetic speech using machine learning.

BACKGROUND

Artificial intelligence is a field of computer engineering and information technology which studies a method capable of performing thinking, learning, and self-development which may be performed with human intelligence by a computer and means to allow the computer to mimic human intelligent behavior.

In addition, artificial intelligence does not exist by itself but has a lot of direct and indirect involvement with other fields of computer science. Especially, in the recent days, in the various fields of the information technology, there are lots of attempts to introduce artificial intelligence elements to solve problems in the field thereof.

A voice agent service using the artificial intelligence is a service that provides information to a user in response to the user's voice. When a sentence is uttered by the user, the available prosody of the speaker varies.

However, since the text analyzer of the related art provides a uniform prosody, it is difficult to reflect the prosody characteristics of the speaker. In a case where a voice is output in a uniform prosody with respect to a sentence, there is a problem that the immersion degree to voice is low by listeners.

SUMMARY

An objective of the present invention is to solve the problems described above and other problems.

An objective of the present invention is to provide, with respect to a text sentence, a synthetic speech having a prosody reflecting a speaker's utterance property.

An objective of the present invention is to correct a prosody analysis result of a text analyzer to a prosody reflecting an utterance property of speakers.

According to an embodiment of the present invention, there is provided a terminal including a memory which stores a prosody correction model; a processor which corrects a first prosody prediction result of a text sentence to a second prosody prediction result based on the prosody correction model and generates a synthetic speech corresponding to the text sentence having a prosody according to the second prosody prediction result; and an audio output unit which outputs the generated synthetic speech.

According to an embodiment of the present invention, there is provided a method for operating a terminal, the method including: correcting a first prosody prediction result of a text sentence to a second prosody prediction result based on a prosody correction model stored in a memory; generating a synthetic speech corresponding to the text sentence having a prosody according to the second prosody prediction result, and outputting the generated synthetic speech via an audio output unit.

A further scope of applicability of the present invention will become apparent from the following detailed description. It should be understood, however, that the detailed description and specific embodiments, such as the preferred embodiments of the invention, are given by way of illustration only since various changes and modifications within the spirit and scope of the invention will be apparent to those skilled in the art.

According to the embodiment of the present invention, a prosody corresponding to the nature of the text is given to the synthetic speech, so that the listening immersion degree of the listener may be improved.

In addition, according to the embodiment of the present invention, a prosody may be given according to an utterance property of a specific speaker rather than being uniform according to a text sentence.

BRIEF DESCRIPTION OF THE DRAWINGS

FIG. 6 is a diagram comparing the advantages and disadvantages of the prosody prediction method based on the text analysis result, the prosody prediction method based on the voice actor utterance result, and the prosody prediction method according to the real-time correction of the text analysis result according to the embodiment of the present invention.

FIG. 7 is a diagram for explaining the detailed configuration and operation of the processor according to the embodiment of the present invention.

FIG. 8 is an example for explaining a break index.

FIG. 9 is a view for explaining text analysis information of a text analyzer according to an embodiment of the present invention.

DETAILED DESCRIPTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that if an element is referred to as being "connected with" another element, the element may be directly connected with the other element or intervening elements may also be present. In contrast, if an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra-books, wearable devices (for example, smart watches, smart glasses, head mounted displays (HMDs)), and the like.

By way of non-limiting example only, further description will be made with reference to particular types of terminals. However, such teachings apply equally to other types of terminals, such as those types noted herein. In addition, these teachings may also be applied to stationary terminals such as digital TV, desktop computers, and the like.

Figure 1:
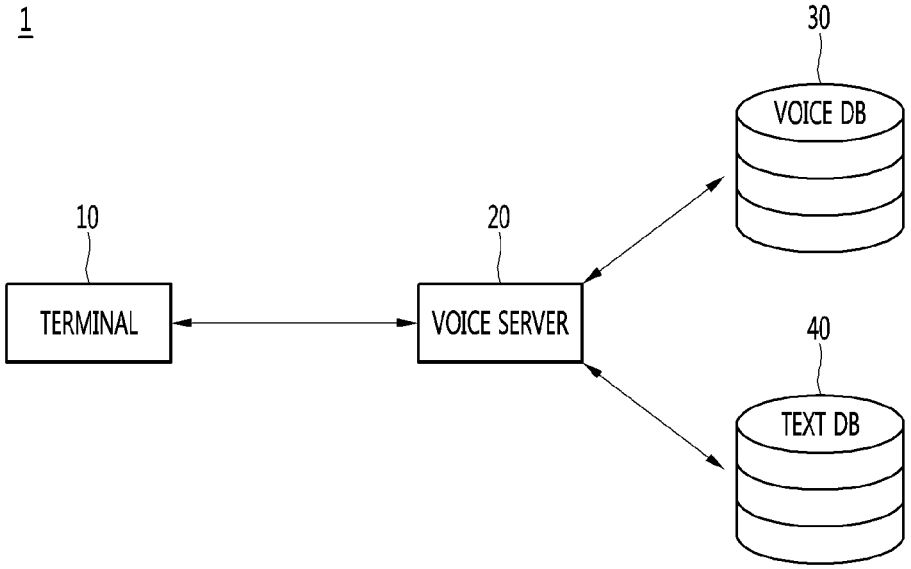
FIG. 1 is a diagram for explaining a configuration of a speech synthesis system according to an embodiment f the present invention.

FIG. 1 is a diagram for explaining a configuration of a speech synthesis system according to an embodiment of the present invention.

A voice synthesis system 1 according to an embodiment of the present invention may include a terminal 10, a voice server 20, a voice database 30, and a text database 40.

The terminal 10 may transmit voice data to the voice server 20.

The voice server 20 may receive the voice data and analyze the received voice data.

The voice server 20 may generate a prosody correction model to be described below and transmit the generated prosody correction model to the terminal 10.

The voice database 30 may store voice data corresponding to each of a plurality of voice actors.

The voice data corresponding to each of the plurality of voice actors may be used later to generate the prosody correction model.

The text database 40 may store text sentences.

The voice database 30 and the text database 40 may be included in the voice server 20.

In another embodiment, the voice database 30 and the text database 40 may be included in the terminal 10.

Figure 2:
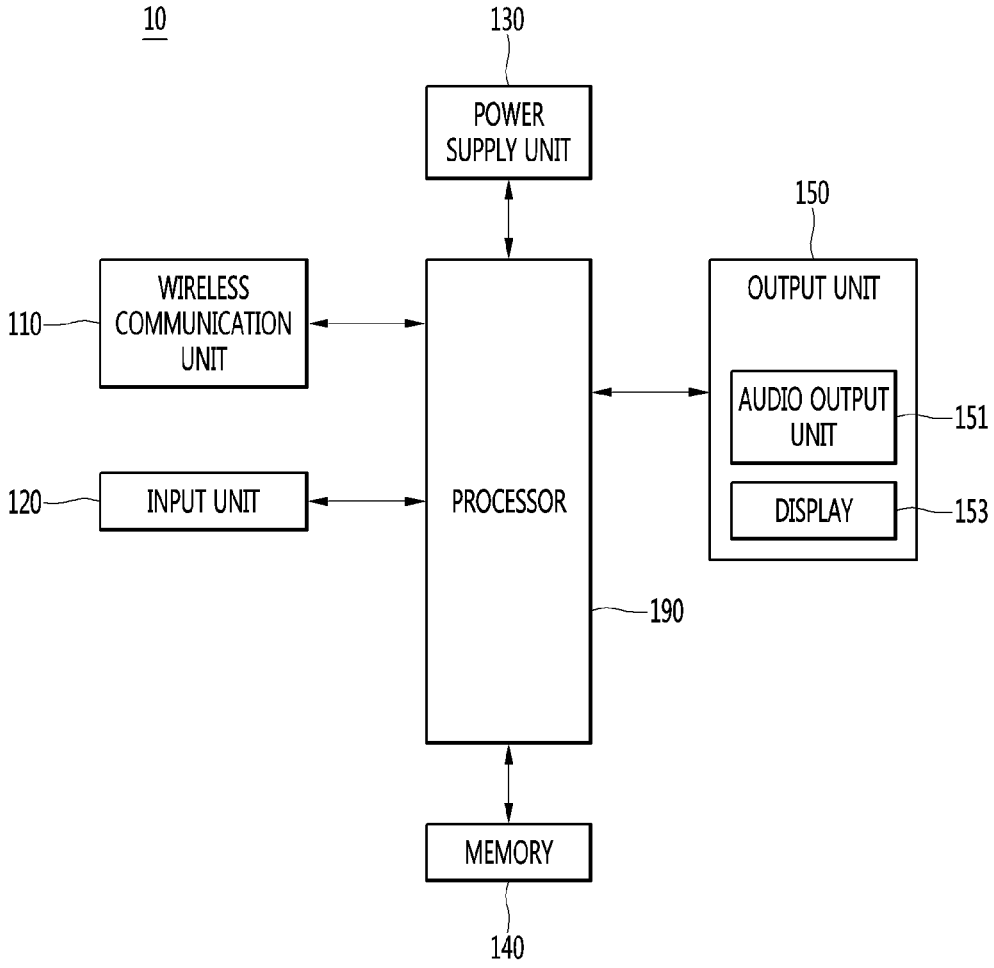
FIG. 2 is a block diagram for explaining a configuration of a terminal according to an embodiment of the present invention.

FIG. 2 is a block diagram for explaining a configuration of a terminal according to an embodiment of the present invention.

In the following embodiments, the prosody may be defined as a sound flow combining a break index of phrases or words included in one sentence.

In addition, in the present invention, the correction model may indicate to generate a representative pattern from a large amount of text data in a statistical manner.

Referring to FIG. 2, the terminal 10 according to an embodiment of the present invention includes a wireless communication unit 110, an input unit 120, a power supply unit 130, a memory 140, an output unit 150, and a processor 190.

The wireless communication unit 110 may perform wireless communication with the voice server 20.

The wireless communication unit 110 may receive the prosody correction model to be described below from voice server 20.

The wireless communication unit 110 may transmit the user's voice received through the input unit 120 to the voice server 20 in real time.

The input unit 120 may include a microphone. The microphone may receive the user's voice.

The power supply unit 130 may supply power to each component of the terminal 10.

The memory 140 may store a prosody correction model. The memory 140 may update the prosody correction model in real time according to a request of the terminal 10 or a request of the voice server 20.

The output unit 150 may include an audio output unit 151 and a display 153.

The audio output unit 151 may include one or more speakers for outputting voice.

The display 153 may display an image.

The processor 190 may control the overall operation of the terminal 10.

The processor 190 may analyze the text sentence input through the input unit 120.

The processor 190 may correct the analysis error using the prosody correction model for the analysis result of the text sentence.

The processor 190 may predict the prosody after correcting the parsing error.

The processor 190 may predict the prosody of the synthetic speech to be output according to the correction result of the parsing error.

The processor 190 may use the predicted prosody to generate a synthetic speech corresponding to the text sentence.

The processor 190 may output the generated synthetic speech through the audio output unit 151.

The specific operation of the processor 190 will be described below.

Figure 3:
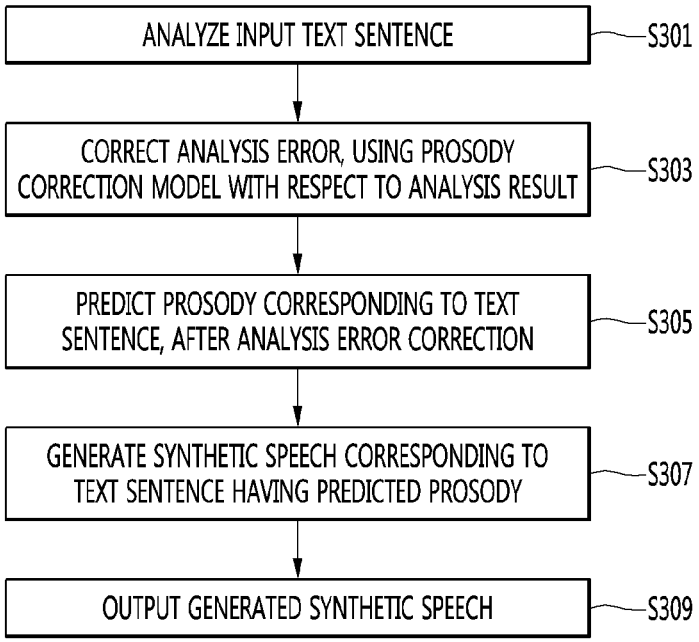
FIG. 3 is a flowchart for explaining a method for operating a terminal according to an embodiment of the present invention.

FIG. 3 is a flowchart for explaining a method for operating a terminal according to an embodiment of the present invention.

Referring to FIG. 3, the processor 190 of the terminal 10 analyzes text sentences input through the input unit 120 (S301).

The input unit 120 may include a microphone (not illustrated) for receiving voice.

In one embodiment, input unit 120 may include a text converter which converts the voice into text.

In one embodiment, the processor 190 may analyze text sentences based on a plurality of analysis elements.

A plurality of analysis elements will be described below.

In addition, the processor 190 may include a text analyzer, which may analyze the text sentences using a plurality of text analysis elements.

The processor 190 corrects the analysis error using the prosody correction model for the analysis result of the text sentences (S303).

In one embodiment, the prosody correction model may be a learning model which maps the analysis results of a text sentence to utterance results of a voice actor.

The processor 190 may correct the analysis error of the analysis result of the text sentence through the prosody correction model.

The prosody correction model will be described with reference to FIG. 4.

In addition, an example of correcting the analysis error using the prosody correction model for the analysis result of the text sentence will be described in detail below.

After correcting the parsing error, the processor 190 predicts the prosody (S305).

The processor 190 may predict the prosody (break index) of the synthetic speech to be output according to the correction result of the parsing error.

The processor 190 generates synthetic speech corresponding to the text sentence using the predicted prosody (S307).

In other words, the processor 190 may generate a synthetic speech that is uttered to have a predicted prosody.

The processor 190 outputs the generated synthetic speech through the audio output unit 151 (S309).

Figure 4:
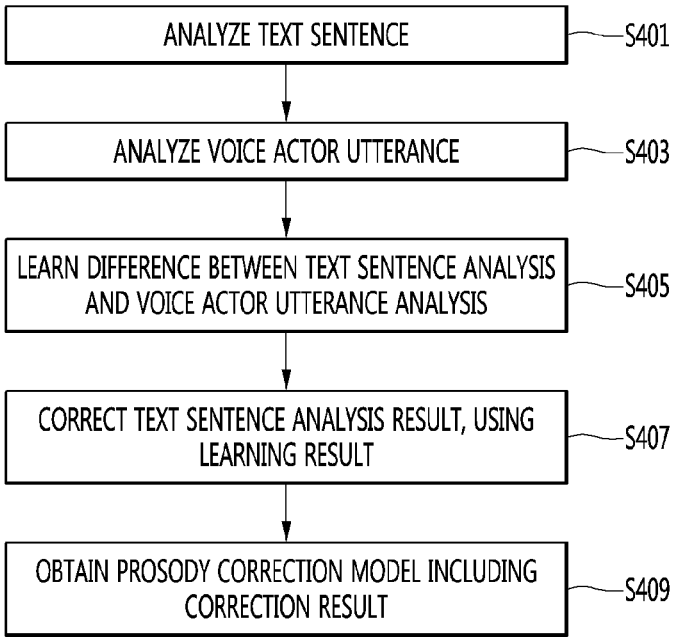
FIG. 4 is a flowchart for explaining a method for generating a prosody correction model by a terminal according to an embodiment of the present invention.

FIG. 4 is a flowchart for explaining a method for generating a prosody correction model by a terminal according to an embodiment of the present invention.

In FIG. 4, the terminal 10 is described as generating the prosody correction model, but the present invention is not limited thereto, and the voice server 20 may generate the prosody correction model.

In a case where the voice server 20 generates a prosody correction model, the terminal 10 may receive the prosody correction model from the voice server 20.

First, the processor 190 of the terminal 10 analyzes the input text sentence (S401).

The processor 190 analyzes the utterance of voice uttered by the voice actor (S403).

The processor 190 learns a difference between the analysis result of the text sentence and the voice actor utterance analysis result (S405).

The processor 190 corrects the text sentence analysis result using the learning result (S407).

The steps S401 to S407 will be described with reference to FIG. 5.

Figure 5:
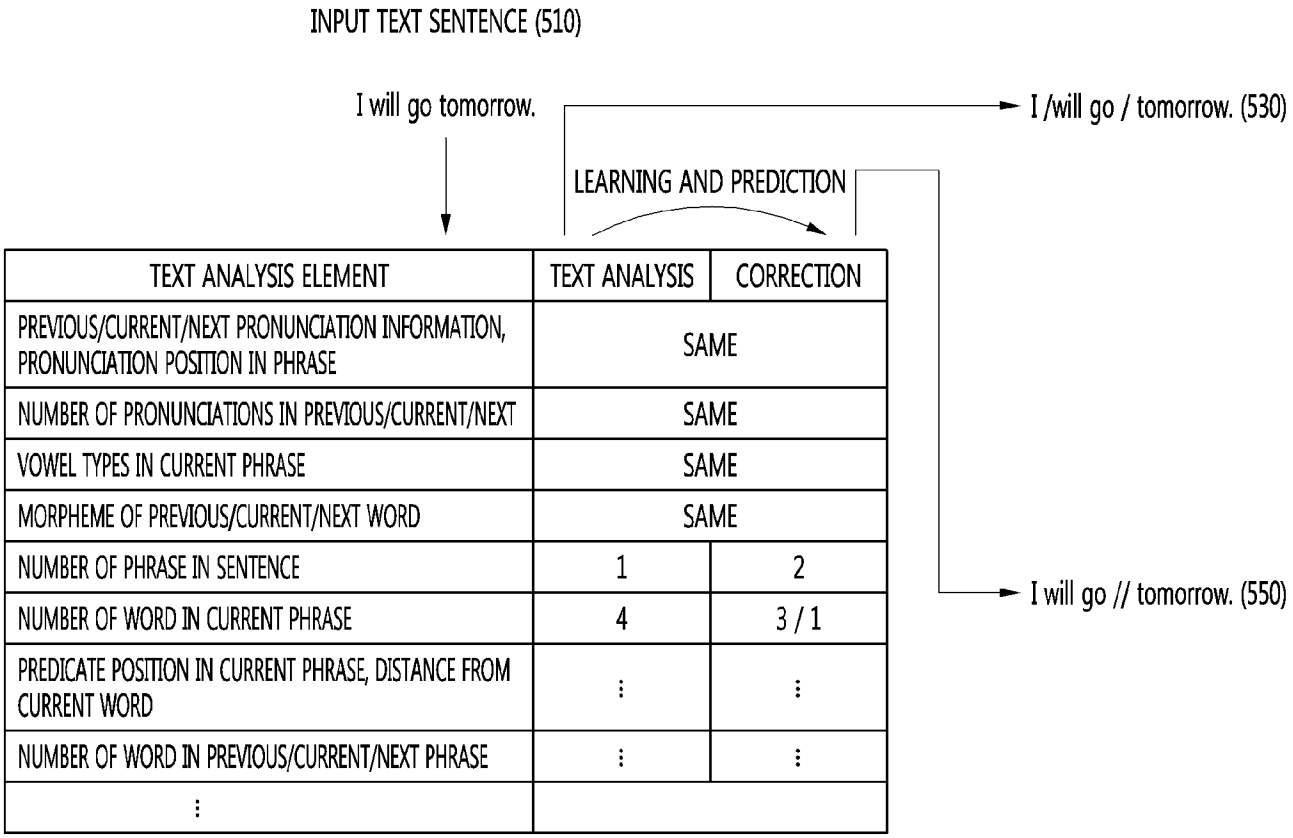
FIG. 5 is a view for explaining an example of correcting a text sentence analysis result using a difference between a text sentence analysis result and an actual voice actor utterance analysis result according to an embodiment of the present invention.

FIG. 5 is a view for explaining an example of correcting a text sentence analysis result using a difference between the text sentence analysis result and the actual voice actor utterance analysis result according to an embodiment of the present invention.

In FIG. 5, it is assumed that the input text sentence 510 is <I will go tomorrow>.

Referring to FIG. 5, the processor 190 uses a plurality of analysis elements for text sentence 510 to obtain a first prosody prediction result 530 through the text analyzer and a second prosody prediction result 550 based on the actual voice actor utterance.

The first prosody prediction result 530 may be a prosody of the text sentence 510 obtained through the text analyzer.

The second prosody prediction result 550 may be a prosody of the text sentence 510 obtained through learning of the voice actor utterance results.

The plurality of analysis elements may include first through seventh elements.

The first element may include previous/current/next pronunciation information and pronunciation position in the phrase.

The second element may be an element which analyzes the number of pronunciations in the previous/current/next word.

The third element may be an element which analyzes vowel the current phrase.

The fourth element may be an element which analyzes the morpheme of the previous/current/next word.

The fifth element may be an element which analyzes the number of phases.

The sixth element may be an element that analyzes the number of words in the current phrase.

The seventh element may be an element which analyzes the number of words in the previous/current/next phrase.

In the analysis of the first prosody prediction result 530 and the second prosody prediction result 550, the first through fourth elements are all the same.

The number of phrases in the text sentence 510 which is the fifth element is one in the result through the text analyzer and two in the result based on the voice actor utterance so that there is a difference in the number of phrases in the text sentence 510.

In addition, the number of words in the current phrase which is the sixth element is four in the result through the text analyzer, and two in the result based on the voice actor utterance, so that there is a difference in the number of words in the current phrase since three words and one word exists in each phrase.

There is a difference in the prosody between the first prosody prediction result 530 according to the analysis through the text analyzer in the related art and the prosody prediction result 550 according to the voice actor utterance analysis.

In FIG. 5, </> and <//> are break spots, and it may represent that the break index of <//> is twice as large as that of </>.

The first prosody prediction result 530 was analyzed to include only one phrase in the sentence <I will go tomorrow>.

In contrast, the second prosody prediction result 550 was analyzed to include two phrases in the sentence <I will go tomorrow>.

Accordingly, the prosody prediction through the text analyzer in the related art does not reflect the utterance of the actual speaker (voice actor), so that the prosody prediction degree was not accurate.

Accordingly, the processor 190 may learn the difference between the first prosody prediction result 530 and the second prosody prediction result 550 to correct the first prosody prediction result 530.

In other words, the processor 190 may map the second prosody prediction result 550 to the first prosody prediction result 530 to correct the analysis results of the fifth element and the sixth element, which are text analysis elements.

Processor 190 may collect the corrected results to generate a prosody correction model.

The prosody correction model may be a correction model which maps the analysis result of the text sentence to the voice actor utterance analysis result.

Specifically, the prosody correction model may be a model for correcting the prosody according to the analysis result of the text sentence to the prosody according to the voice actor utterance analysis result.

The prosody correction model may be the correction model obtained by learning the difference between the first prosody prediction result 530 and second prosody prediction result 550.

The processor 190 may learn the difference between the first prosody prediction result 530 and the second prosody prediction result 550 using a plurality of analysis elements and obtain a prosody correction model according to the learning result.

The processor 190 obtains a prosody correction model based on the correction result (S409).

The processor 190 may predict the prosody of the text sentence input through the input unit 120 based on the obtained prosody correction model.

FIG. 6 is a diagram comparing the advantages and disadvantages of the prosody prediction method based on the text analysis result, the prosody prediction method based on the voice actor utterance result, and the prosody prediction method according to the real-time correction of the text analysis result according to the embodiment of the present invention.

First, the advantage of the prosody prediction method based on the text analysis result is that the learning and prediction are possible using the text analysis data. However, the disadvantage of this method is that the error of the text analyzer may be generated, the utterance property of the speaker may not be reflected, and only a uniform prosody may be provided.

The advantage of the prosody prediction based on the voice actor utterance result is that prosody learning and prediction which are close to actual voice data may be performed. However, this method is not suitable for synthesizing speech in real time.

The prosody prediction method according to the real-time correction of the text analysis result according to the embodiment of the present invention may have both the advantages of the prosody prediction method based on the text analysis result and the advantages of the prosody prediction method based on the voice actor utterance result.

Especially, this method has the advantage of correcting the error of the text analysis result by learning the difference between the text analysis result and the voice actor utterance result, thus being capable of performing various prosody predictions.

In addition, the prosody prediction accuracy based on the voice actor utterance may be improved.

FIG. 7 is a diagram for explaining the detailed configuration and operation of the processor according to the embodiment of the present invention.

Referring to FIG. 7, the processor 190 may include a text analyzer or text analysis unit 191 and an error corrector or error correction unit 193.

The text analyzer 191 may analyze the input text using a plurality of analysis elements illustrated in FIG. 5.

The error correction unit 193 may apply the prosody correction model to the text analysis result of the text analyzer 191 to correct the text analysis result.

Specifically, the error correction unit 193 may correct the first prosody prediction result such that the first prosody prediction result according to the text analysis result is changed to the second prosody prediction result based on the voice actor utterance.

The processor 190 may synthesize the voice corresponding to the corrected result and output the synthetic speech through the audio output unit 151.

FIG. 8 is an example for explaining a break index.

The break index may have values of 0 to 3. It is possible to indicate that the break index is small as the number goes down to zero, and the break index is large as the number goes up to three.

In other words, it may mean that a break time is long as the break index increases from 0 to 3.

The prosody may vary according to the break index of a phrase or a word in a sentence.

FIG. 9 is a view for explaining text analysis information of a text analyzer according to an embodiment of the present invention.

Although only some of the analysis elements for text analysis are illustrated in FIG. 5, the actual text analyzer may extract more analysis elements illustrated in FIG. 9 to analyze the text sentence.

The present invention described above may be implemented as the computer readable codes on a medium on which a program is recorded. The computer readable medium includes all kinds of recording devices in which data that may be read by a computer system is stored. Examples of the computer-readable medium include a hard disk drive (HDD), a solid state disk (SSD), a silicon disk drive (SDD), a ROM, a RAM, a CD-ROM, a magnetic tape, a floppy disk, an optical data storage device, or the like. In addition, the computer may also include a processor of the voice server.

Accordingly, the detailed description is not to be construed in all aspects as limited but should be considered as illustrative. The scope of the present invention should be determined by rational interpretation of the appended claims, and all changes within the scope of equivalents of the present invention are included in the scope of the present invention.

The present invention mentioned in the foregoing description may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the mobile terminal.

The foregoing embodiments are merely exemplary and are not to be considered as limiting the present disclosure. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A terminal comprising:

a memory configured to store a prosody correction model;

an audio output unit comprising a speaker; and a processor operably coupled with the memory and the audio output, unit and configured to:

correct a first prosody prediction result of a text sentence to a second prosody prediction result based on the prosody correction model stored in the memory, wherein the first prosody prediction result is a prosody of the text sentence obtained through a text analyzer, and the second prosody prediction result is a prosody of the text sentence obtained by learning a voice actor utterance result;

generate a synthetic speech corresponding to the text sentence, the synthetic speech having a prosody according to the second prosody prediction result; and cause the audio output, unit to output the generated synthetic speech, wherein the prosody correction model is obtained by learning a difference between the first prosody prediction result and the second prosody prediction result.

2. The terminal according to claim 1, wherein the processor is further configured to learn the difference between the first prosody prediction result and the second prosody prediction result using a plurality of analysis elements.

3. The terminal according to claim 2, wherein the plurality of analysis elements includes:

a first element which analyzes a number of words and a word position in a current phrase included in the text sentence; and a second element which analyzes a predicate position and a distance from a current word in the current phrase.

4. The terminal according to claim 3, wherein the processor includes:

a text analyzer configured to analyze the text sentence using the plurality of analysis elements; and an error correction unit configured to correct an error in an analysis result obtained by the text analyzer using the prosody correction model.

5. The terminal according to claim 4, wherein the prosody correction model corrects the prosody according to the analysis result of the text analyzer to the prosody according to the voice actor utterance analysis result.

6. A method for operating a terminal by a processor of the terminal operably coupled with a memory and an audio output unit, and the method comprising:

correcting a first prosody prediction result of a text sentence to a second prosody prediction result based on a prosody correction model stored in the memory, wherein the first prosody prediction result is a prosody of the text sentence obtained through a text analyzer, and wherein the second prosody prediction result is a prosody of the text sentence obtained by learning a voice actor utterance result;

generating a synthetic speech corresponding to the text sentence such that the synthetic speech has a prosody according to the second prosody prediction result; and causing the audio output unit to output the generated synthetic speech, wherein the prosody correction model is obtained by learning a difference between the first prosody prediction result and the second prosody prediction result.

7. The method according to claim 6, further comprising:

learning a difference between the first prosody prediction result and the second prosody prediction result using a plurality of analysis elements.

8. The method according to claim 7, wherein the plurality of analysis elements includes:

a first element which analyzes a number of words and a word position in a current phrase included in the text sentence; and a second element which analyzes a predicate position and a distance from a current word in the current phrase.

9. The method according to claim 8, wherein the learning includes:

analyzing, by a text analyzer, the text sentence using the plurality of analysis elements; and analyzing, by an error correction unit, an error in an analysis result by the text analyzer, using the prosody correction model.

10. The method according to claim 9, wherein the prosody correction model corrects the prosody according to the analysis result of the text analyzer to the prosody according to the voice actor utterance analysis result.

* * * * *